US010087506B2

(12) United States Patent
Park et al.

(10) Patent No.: US 10,087,506 B2
(45) Date of Patent: Oct. 2, 2018

(54) ULTRAHIGH STRENGTH AND ULTRALOW ELASTIC MODULUS TITANIUM ALLOY SHOWING LINEAR ELASTIC DEFORMATION BEHAVIOR

(71) Applicant: KOREA INSTITUTE OF MACHINERY & MATERIALS, Daejeon (KR)

(72) Inventors: Chan Hee Park, Gyeongsangnam-do (KR); Jong Taek Yeom, Gyeongsangnam-do (KR); Seung Eon Kim, Gyeongsangnam-do (KR); Seong Woong Kim, Gyeongsangnam-do (KR); Jeoung Han Kim, Gyeongsangnam-do (KR); Jae Keun Hong, Gyeongsangnam-do (KR)

(73) Assignee: Korea Institute of Machinery & Materials, Daejeon (KR)

( * ) Notice: Subject to any disclaimer, the term of this patent is extended or adjusted under 35 U.S.C. 154(b) by 247 days.

(21) Appl. No.: 14/370,270

(22) PCT Filed: Mar. 28, 2013

(86) PCT No.: PCT/KR2013/002598
§ 371 (c)(1),
(2) Date: Jul. 2, 2014

(87) PCT Pub. No.: WO2014/073754
PCT Pub. Date: May 15, 2014

(65) Prior Publication Data

US 2014/0322067 A1 Oct. 30, 2014

(30) Foreign Application Priority Data

Nov. 8, 2012 (KR) ..... 10-2012-0125772

(51) Int. Cl.
*C22C 14/00* (2006.01)
*C22F 1/18* (2006.01)

(52) U.S. Cl.
CPC ..... *C22C 14/00* (2013.01); *C22F 1/183* (2013.01)

(58) Field of Classification Search
CPC ..... C22C 14/00; C22F 1/183
(Continued)

(56) References Cited

U.S. PATENT DOCUMENTS 5,871,595 A 2/1999 Ahmed et al.

FOREIGN PATENT DOCUMENTS

CN 101760669 A 6/2010
JP 02-107734 4/1990
(Continued)

OTHER PUBLICATIONS

Guo et al. ("Microstructures and Mechanical Properties of Metastable B Type TiNbZrFe Alloys for Biomedical Applications", Journal Matls. & Metallurgy, Dec. 2008, vol. 7, No. 4, 288-292).*
(Continued)

*Primary Examiner* — Weiping Zhu
(74) *Attorney, Agent, or Firm* — Loza & Loza, LLP; Heidi Eisenhut

(57) ABSTRACT

A titanium alloy having ultrahigh strength and ultralow elastic modulus, and showing linear elastic deformation behavior is disclosed. The titanium alloy (Ti-20Nb-5Zr-1Fe-O) of the present invention consists of titanium, niobium, zirconium, iron and oxygen. More specifically, the amount of niobium is 18 to 22 at. %, the amount of zirconium is 3 to 7 at. %, the amount of iron is 0.5 to 3.0 at. %, the amount of oxygen is 0.1 to 1.0 wt. %, and the balance is titanium.

8 Claims, 10 Drawing Sheets

(58) Field of Classification Search
USPC ..... 420/417
See application file for complete search history.

(56) References Cited

FOREIGN PATENT DOCUMENTS

| | | | | |
|---|---|---|---|---|
| JP | 2005029845 | A | | 2/2005 |
| JP | 2008196044 | A | | 8/2008 |
| JP | 2010001502 | A | * | 1/2010 |

OTHER PUBLICATIONS

Office Action for Chinese Patent Application No. 201380017526.4 dated Sep. 25, 2015; 6 pages.
Guo et al, "Microstructures & mechanical properties of metastable B type TiNbZrFe alloys for biomedical application", Journal Matls & Metallurgy, Dec. 2008, vol. 7 No. 4, 288-292.
JP 6006872B2. Applicant: Korea Institute of Machinery & Materials. Published Gazette (Oct. 12, 2016).

* cited by examiner

| Bo | Md(eV) | e/a ratio |
|---|---|---|
| 2.87 | 2.45 | 4.24 |

| 3d | Bo | Md(eV) | 4d | Bo | Md(eV) | 5d | Bo | Md(eV) | Other | Bo | Md(eV) |
|---|---|---|---|---|---|---|---|---|---|---|---|
| Ti | 2.790 | 2.447 | Zr | 3.086 | 2.934 | Hf | 3.110 | 2.975 | Al | 2.426 | 2.200 |
| V | 2.805 | 1.872 | Nb | 3.099 | 2.424 | Ta | 3.144 | 2.531 | Si | 2.561 | 2.200 |
| Cr | 2.779 | 1.478 | Mo | 3.063 | 1.961 | W | 3.125 | 2.072 | Sn | 2.283 | 2.100 |
| Mn | 2.723 | 1.194 | Tc | 3.026 | 1.294 | Re | 3.061 | 1.490 | | | |
| Fe | 2.651 | 0.969 | Ru | 2.704 | 0.859 | Os | 2.980 | 1.018 | | | |
| Co | 2.529 | 0.807 | Rh | 2.736 | 0.561 | Ir | 3.168 | 0.677 | | | |
| Ni | 2.412 | 0.724 | Pd | 2.208 | 0.347 | Pt | 2.252 | 0.146 | | | |
| Cu | 2.114 | 0.567 | Ag | 2.094 | 0.196 | Au | 1.953 | 0.258 | | | |

M.Morinaga,Titanium 92, Science and technology 217

Fig. 3

| Ti | Nb | Ta | Hf | Zr | Fe | Mo | Cr |
|---|---|---|---|---|---|---|---|
| $[Ar]3d^2 4s^2$ | $[Kr]4d^4 5s^1$ | $[Xe]4f^{14} 5d^3 6s^2$ | $[Xe]4f^{14} 5d^2 6s^2$ | $[Kr]4d^2 5s^2$ | $[Ar]3d^6 4s^2$ | $[Kr]4d^5 5s^1$ | $[Ar]3d^5 4s^1$ |

Fig. 4

- Ultrasonic Inspection Device: USD15, Oscilloscope (DataSYS740)
- Probe: A109R, 5 MHz/0.5 in. Longitudinal wave, Panametrics (USA)
  V155, 5.0MHz/0.5in. Transverse wave, Panametrics (U.S.A)
- Specimen: Plate Type

| Material | Elastic Modulus (GPa) |
|---|---|
| Pure Ti | 106~109 |
| Ti-20Nb-5Zr-1Fe (at.%) | 59 |

| Alloy | Tensile Strength (MPa) | Elastic modulus (Gpa) |
|---|---|---|
| Commercially pure Ti grade 2 * | 345 | 102.7 |
| Ti-6Al-4V ELI* | 860-965 | 101-110 |
| Ti-6Al-7V* | 900-1050 | 114 |
| Ti-5Al-2.5Fe* | 1020 | 112 |
| Ti-5Al-1.5B * | 925-1080 | 110 |
| Ti-15Sn-4Nb-2Ta-0.2Pd * | 860 | 89 |
| Ti-13Nb-13Zr * | 973-1037 | 79-84 |
| Ti-12Mo-6Zr-2Fe* | 1060-1100 | 74-85 |
| Ti-15Mo* | 874 | 78 |
| Ti-15Mo-5Zr-3Al* | 852 | 80 |
| Ti-15Mo-2.8Nb-0.2Si * | 979-999 | 83 |
| Ti-35.3Nb-5.1Ta-7.1Zr * | 596.7 | 55 |
| Ti-36Nb-2Ta-3Zr-0.30 **,*** | 1030 | 55 |
| Ti-20Nb-5Zr-1Fe (at.%, present alloy) | 1190 | 59 |

Sources

*Materials Science and Engineering A243 (1998) 231

**Science 300 (2003) 464

***Acta Materialia 58 (2010) 3271

Fig. 9

| | Before Cold Working | After Cold Working |
|---|---|---|
| Tensile Strength (MPa) | More than 900 | More than 1150 |
| Elongation (%) | More than 18 | More than 8 |

ULTRAHIGH STRENGTH AND ULTRALOW ELASTIC MODULUS TITANIUM ALLOY SHOWING LINEAR ELASTIC DEFORMATION BEHAVIOR

BACKGROUND OF THE INVENTION

1. Field of the Invention

This invention relates to an ultrahigh strength and ultralow elastic modulus titanium alloy showing linear elastic deformation behavior, wherein the structure of the titanium alloy is beta. Compared with conventional titanium alloys having similar properties and applications, the strength of the titanium alloy is so high that it is more than 1150 megapascal (MPa) and the elastic modulus is so low that it is less than 60 gigapascal (GPa).

2. Description of the Related Art

A titanium alloy is a representative lightweight metal. Because of its high specific strength and excellent corrosion resistance, it may be utilized in a variety of applications, such as aerospace industry, chemical engineering field, use as an in vivo implant material, sports equipment, and so on. Such a titanium alloy has been known as a material creating significant added value in various industrial fields based on its characteristics which cannot be easily obtained in other materials.

Elastic modulus difference between bones and conventional titanium alloys used as in vivo implants is very huge. Such huge difference frequently causes bone stress shielding that a low stress is applied in a bone structure having a relatively low elastic modulus. It makes the body system perceive the bone structure in which the low stress is applied as an unnecessary part, which activates osteoclasts and, therefore, dissolves the bone structure.

It is at present necessary to develop a low elastic modulus titanium alloy for use as an in vivo implant material in order to minimize the bone stress shielding phenomenon. Particularly, implants for orthopedic devices require not only low elastic modulus and high strength but also superelasticity and superplasticity giving good formability, since their forged shape is very complicated. It is therefore urgent to develop the titanium alloy meeting such requirements. The titanium alloy having such low elastic modulus, high strength, superelasticity, and superplasticity may be employed in various fields including aerospace, electricity generation, household items, and other industrial parts, as well in vivo implants. It may be also employed as injection mold materials for use under corrosion or other peculiar environments. Stainless steels, such as 316L type stainless steel, and cobalt alloys have been used as in vivo implant materials. However, those metals are implanted in a human body, they produce some problems as follows: first, metal ions are released in blood by in vivo corrosion, which spread all over the body along blood vessels and cause various diseases; second, when implants made of metals without bioactivity are inserted into the body, they are easily separated from the implanted parts over time after implanting; last, because the elastic modulus of such implants is so higher than that of the bone that the bone tissues around the implants are damaged due to the bone stress shielding, the implants become loose against the implanted parts and, therefore, reoperation is needed.

Researches to develop a titanium alloy with high biocompatibility have been actively done in order to solve such problems. Specially, researchers have tried to obtain a titanium alloy with ultrahigh strength and ultralow elastic modulus, which cannot be obtained in conventional pure titanium metal and Ti-6Al-4V alloys. Because the titanium alloy with high strength and low elastic modulus can improve compatibility with bone tissues and avoid the bone stress shielding compared with prior alloys with high strength and high elastic modulus, researches about such a titanium alloy have been undertook at home and abroad.

U.S. Pat. No. 5,954,724 discloses a low modulus titanium alloy suitable for use in the construction of medical implants and devices, and U.S. Pat. No. 7,887,584 discloses medical devices containing at least one amorphous metal alloy. However, those patents only focus on development of a low elastic modulus titanium alloy, since the elastic modulus of conventional titanium alloys and other metals is higher than that of the bone. Until now, there is no success in developing a titanium alloy having improved mechanical and physical properties in addition to lower elastic modulus.

SUMMARY OF THE INVENTION

The object of the present invention is to provide a titanium alloy having ultrahigh strength and ultralow elastic modulus, and showing linear elastic deformation behavior in order to solve the problems mentioned above, wherein the titanium alloy consists of titanium, niobium, zirconium, iron and oxygen.

Another object of the present invention is to provide a titanium alloy having ultrahigh strength and ultralow elastic modulus, and showing linear elastic deformation behavior, wherein the titanium alloy comprises niobium of 18 to 22 at. %, zirconium of 3 to 7 at. % iron of 0.5 to 3.0 at. %, oxygen of 0.1 to 1.0 wt. %, and titanium of the balance.

The titanium alloy of the present invention is different from most of conventional titanium alloys in that it is free of a high melting point metal, that is, tantalum (the melting point is 3000° C.), which severely tends to be inhomogeneously distributed when melted and solidified in large quantities. Therefore, the titanium alloy is suitable in mass production and can be cold-deformed more than 90%.

According to the present invention, the titanium alloy consists of titanium, niobium, zirconium, iron and oxygen. More specifically, the titanium alloy comprises niobium of 18 to 22 at. %, zirconium of 3 to 7 at. %, iron of 0.5 to 3.0 at. %, oxygen of 0.1 to 1.0 wt. %, and titanium of the balance.

According to the present invention, the elastic modulus of the titanium alloy is 68 GPa before cold working and 60 GPa after cold working, and the titanium alloy shows linear elastic deformation behavior suitable for use as an in vivo material.

According to the present invention, the amount of linear elastic deformation of the titanium alloy is more than 1%.

According to the present invention, the tensile strength of the titanium alloy is more than 900 MPa before cold working and more than 1150 MPa after cold working, and the elongation of the titanium alloy is more than 18% before cold working and more than 8% after cold working.

Because the titanium alloy of the present invention has low elastic modulus, high strength, superelasticity, and superplasticity, it may be employed in various fields including aerospace, electricity generation, household items, and other industrial parts, as well in vivo implants. It may be also employed as injection mold materials for use under corrosion or other peculiar environments.

Conventional titanium alloys are very expensive because of their poor deformability. However, since the titanium alloy of the present invention shows excellent deformability due to its superelasticity and superplasticity, it may be cheaply manufactured and conveniently applied in various industrial fields. As mentioned above, when stainless steels, such as 316L type stainless steel, and cobalt alloys are implanted in a human body, they cause some problems (first, metal ions are released in blood by in vivo corrosion, which spread all over the body along blood vessels and cause various diseases; second, when implants made of metals without bioactivity are inserted into the body, they are easily separated from the implanted parts over time after implanting; last, because the elastic modulus of such implants is so higher than that of the bone that the bone tissues around the implants are damaged due to the bone stress shielding, the implants become loose against the implanted parts and, therefore, reoperation is needed). However, such problems may be easily overcome by the titanium alloy of the present invention. Further, the titanium alloy of the present invention is free of tantalum, which severely tends to be inhomogeneously distributed when melted and solidified in large quantities due to its high melting point (3000° C.). Therefore, the titanium alloy of the present invention is suitable in mass production because of homogeneous distribution of its components, and can be cold-deformed more than 90%.

BRIEF DESCRIPTION OF THE DRAWINGS

FIG. 3 is a table showing the values of Bo and Md obtained by the DV-Xα cluster method for various metals, which are two of the necessary conditions mentioned in the table of FIG. 2.

FIG. 4 is a table showing the value of electron/atom ratio (e/a) for various metals, which is also one of the necessary conditions mentioned in the table of FIG. 2.

FIG. 9 is a table showing the strength and elastic modulus of some of conventional titanium alloys and the titanium alloy of the present embodiment.

DETAILED DESCRIPTION OF THE PREFERRED EMBODIMENTS

The present invention will become more apparent when the detailed description of exemplary embodiment is considered in conjunction with the drawings. However, the embodiment is to be considered as illustrative and not restrictive, the scope of the invention being indicated by the appended claims rather than by the following description, and all changes which come within the meaning and range of equivalency of the claims are therefore intended to be embraced therein.

Figures 1, 2:
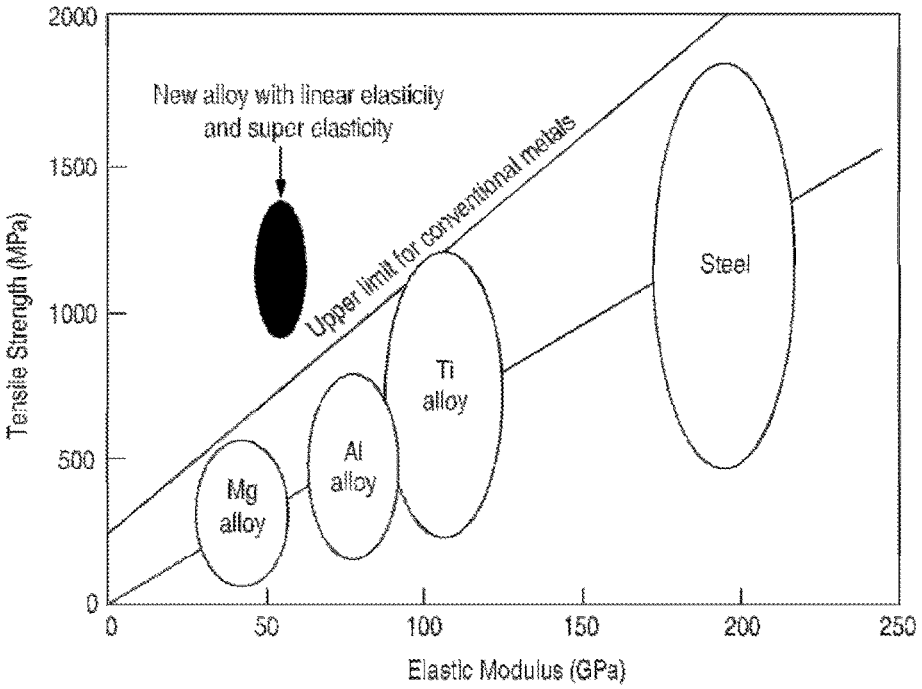
FIG. 1 is a graph showing properties of conventional metals and a new alloy to be developed by the present invention.
FIG. 2 is a table showing the necessary conditions for developing a titanium alloy which has ultrahigh strength and ultralow elastic modulus, and shows linear elastic deformation behavior.

FIG. 1 is a graph showing properties of conventional metals and a new alloy to be developed by the present invention.

The graph indicates the properties required for developing the new alloy which has ultrahigh strength and ultralow elastic modulus. The target metal to be developed according to the present invention is a beta titanium alloy having properties of low elastic modulus less than 70 GPa, high strength, high corrosion resistance, non-cytotoxic behavior, superelasticity, and superplasticity (a material similar to so-called gum metal). New alloys can be developed through steps of alloy design based on numerical simulation and experiment, vacuum melting and forging, metal mold design and die forging, evaluation of properties and reliability, and so on. Compared with properties of the target titanium alloy having low elastic modulus and high strength, the elastic moduli for magnesium alloys, aluminum alloys, titanium alloys, and steels can be seen in the graph. The target titanium alloy is different from gum metal (Ti-23Nb-0.7Ta-2Zr—O) recently developed by Toyota Motor Corporation (Science vol. 300, 2003) in that it has ultrahigh strength and ultralow elastic modulus, and shows non-linear elastic deformation behavior. The target titanium alloy may be employed in various fields including in vivo implants, aerospace, electricity generation, and other industrial parts. It may be also employed as injection mold materials for use under corrosion or other peculiar environments. In addition, it may be employed as eyeglass frames, finely threaded screws, parts of an automobile, sports equipment, decoration items, and other household items.

Elastic modulus difference between bones and conventional titanium alloys used as in vivo implants is very huge. As said, such huge difference frequently causes the bone stress shielding, which makes the body system perceive the low-stressed bone structure as an unnecessary part. The body system activates osteoclasts and, therefore, dissolves the bone structure. It is at present necessary to develop a low elastic modulus titanium alloy for use as an in vivo implant material in order to minimize the bone stress shielding phenomenon. Particularly, implants for orthopedic devices require not only low elastic modulus and high strength but also superelasticity and superplasticity giving good formability, since their forged shape is very complicated. It is therefore urgent to develop a titanium alloy meeting such requirements. The titanium alloy having such low elastic modulus, high strength, superelasticity, and superplasticity may be employed in various fields including aerospace, electricity generation, household items, and other industrial parts, as well in vivo implants. It may be also employed as injection mold materials for use under corrosion or other peculiar environments. Further, conventional titanium alloys are very expensive, because of their poor deformability. Therefore, the target titanium alloy must have excellent deformability, or superelasticity and superplasticity such that they may be cheaply manufactured and conveniently applied in various industrial fields.

After titanium alloys having low elastic modulus, high strength, superelasticity, and superplasticity (so called 'gum metal') were for the first time developed by Toyota Motor Corporation, attempts have been continuously made to apply them to the biomedical field, because of a great ripple effect to the related industry.

Further, as mentioned above, stainless steels, such as 316L type stainless steel, and cobalt alloys have been used as in vivo implant materials. However, when those metals are implanted in a human body, they produce some problems as follows: first, metal ions are released in blood by in vivo corrosion, which spread all over the body along blood vessels and cause various diseases; second, when implants made of metals without bioactivity are inserted into the body, they are easily separated from the implanted parts over time after implanting; last, because the elastic modulus of such implants is so higher than that of the bone that the bone tissues around the implants are damaged due to the bone stress shielding, the implants become loose against the implanted parts and, therefore, reoperation is needed.

Researches about a titanium alloy with high bio-compatibility have been actively done in order to solve such problems. Specially, researchers have tried to develop a titanium alloy with ultrahigh strength and ultralow elastic modulus, which cannot be obtained in conventional pure titanium metal and Ti-6Al-4V alloys. Because the titanium alloy with high strength and low elastic modulus can improve compatibility with bone tissues and avoid the bone stress shielding compared with prior alloys with high strength and high elastic modulus, researches relating to such an alloy have been undertook at home and abroad.

Since the elastic modulus of conventional titanium alloys and other metals is higher than that of the bone, we tried to develop a titanium alloy having improved mechanical and physical properties in addition to lower elastic modulus. Our target titanium alloy having ultrahigh strength and ultralow elastic modulus together with desired linear elastic deformation behavior is placed at a red-colored, upper-left region in the graph shown in FIG. 1.

FIG. 2 is a table showing the necessary conditions for developing the titanium alloy which has ultrahigh strength and ultralow elastic modulus, and shows linear elastic deformation behavior.

There are three necessary conditions for developing the titanium alloy. First, DV-Xα:bond order, that is, Bo is 2.87; second, DV-Xα:"d" electron-orbital energy level, that is, Md is 2.45 eV, and, last, Electron/atom ratio (s.p.d) is 4.24.

FIG. 3 is a table showing the values of Bo and Md for various metals, which were obtained by the DV-Xα cluster method. They are two of the necessary conditions mentioned in the table of FIG. 2

From the above table, we found that the best components for the titanium alloy having ultrahigh strength and ultralow elastic modulus were Ti, Nb, Zr, and Fe. Therefore, the titanium alloy of the present invention consisted of titanium, niobium, zirconium, iron and oxygen. More specifically, the amount of niobium was 18 to 22 at. %, the amount of zirconium was 3 to 7 at. %, the amount of iron was 0.5 to 3.0 at. %, the amount of oxygen was 0.1 to 1.0 wt. %, and the balance was titanium.

According to the present invention, the elastic modulus of the titanium alloy was 68 GPa before cold working and 60 GPa after cold working, and the titanium alloy showed linear elastic deformation behavior suitable for use as an in vivo material. Further, the amount of linear elastic deformation of the titanium alloy was more than 1%.

Figure 5:
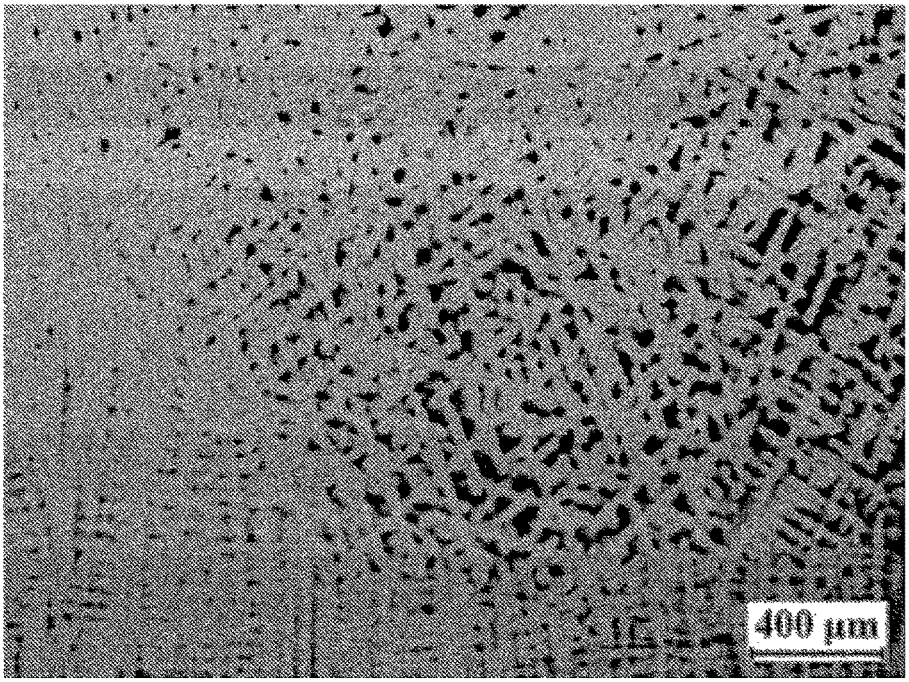
FIG. 5 is a photograph showing microstructure obtained after homogenizing the titanium alloy according to the present embodiment, which has ultrahigh strength and ultralow elastic modulus, and shows linear elastic deformation behavior.

FIG. 5 is a photograph showing microstructure obtained after homogenizing the titanium alloy of the present embodiment.

Dendrites generally developing after homogenizing were observed.

Figure 6:
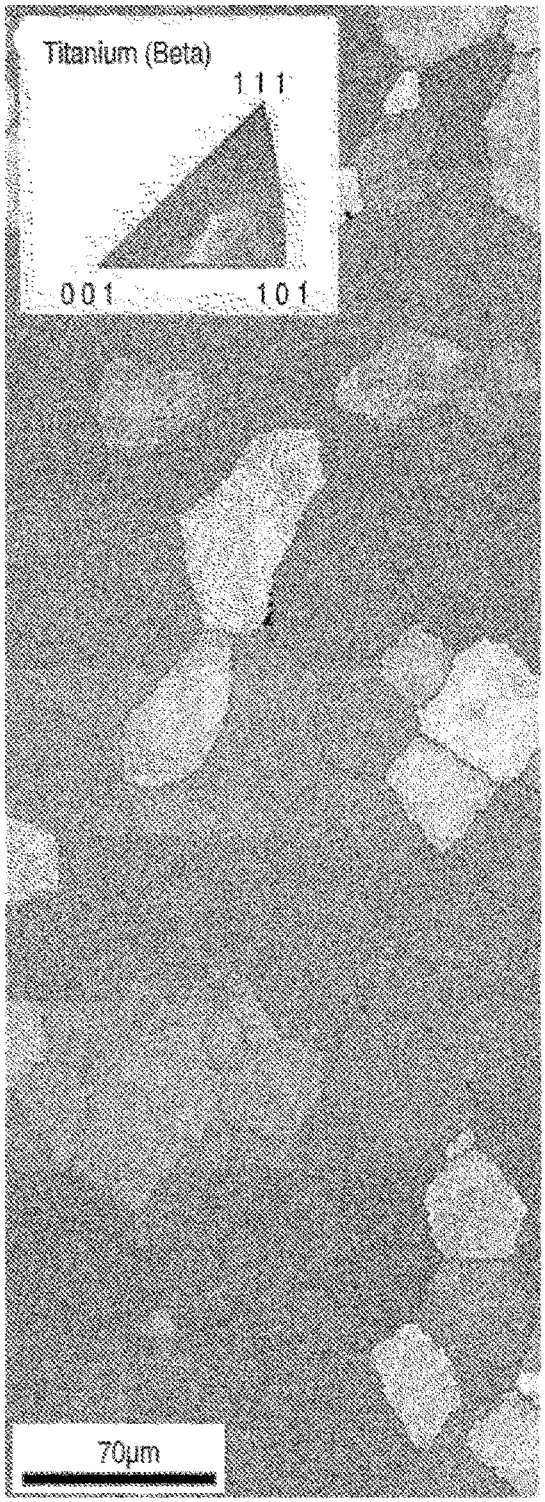
FIG. 6 is a SEM image obtained after hot-forging the titanium alloy of the present embodiment.

FIG. 6. is a SEM image obtained after hot-forging the titanium alloy of the present embodiment.

It was found that the dendrites were broken during the hot forging and equiaxed grains were uniformly produced.

Figure 7:
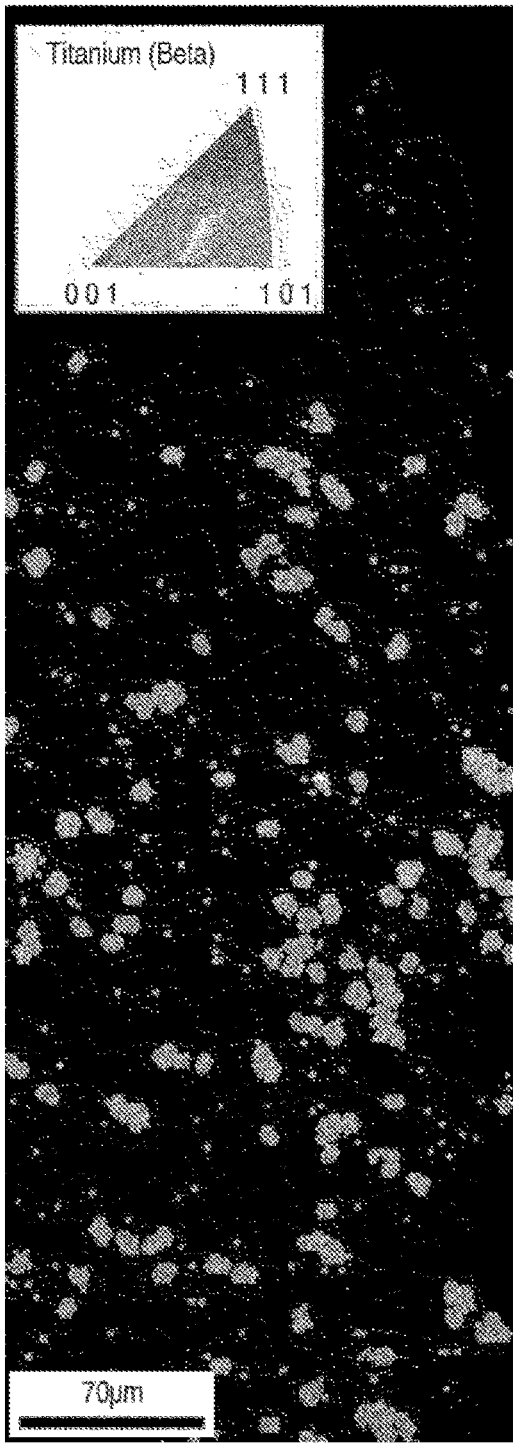
FIG. 7 is a SEM image obtained after cold-deforming the titanium alloy of the present embodiment more than 90%.

FIG. 7 is a SEM image obtained after cold-deforming the titanium alloy of the present embodiment more than 90%.

It was found that, even though a large amount of deformation was applied to the titanium alloy, the alloy absorbed the deformation and was not fractured.

Figure 8:
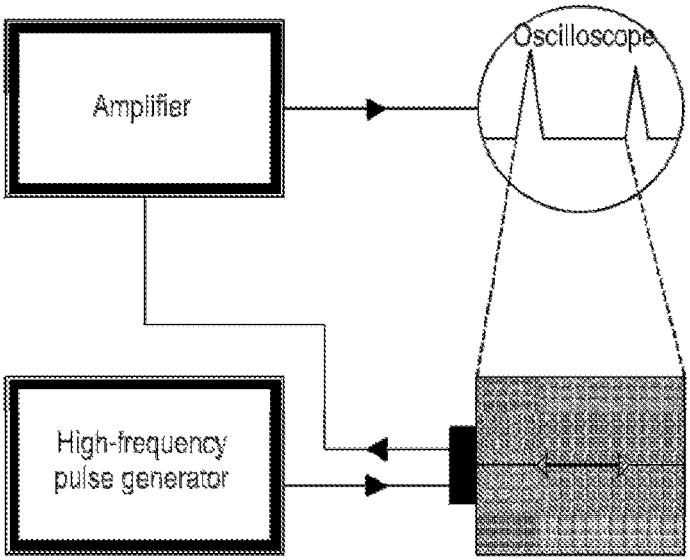
FIG. 8 is a table showing the elastic modulus of pure titanium metal and the titanium alloy of the present embodiment measured by ultrasonic inspection.

FIG. 8 is a table showing the elastic modulus of pure titanium metal and the titanium alloy of the present embodiment measured by ultrasonic inspection.

Compared with the elastic modulus of pure titanium metal generally having 105~110 GPa, it was found the elastic modulus of the titanium alloy of the present invention was very low, and therefore, reliability to the present invention was confirmed.

FIG. 9 is a table showing the strength and elastic modulus of some of conventional titanium alloys and the titanium alloy of the present embodiment.

The strength of the titanium alloy of the present invention was higher than that of Ti-36Nb-2Ta-3Zr-0.3O alloys (gum metal) showing the best mechanical properties among the materials already had developed. Astonishingly, the strength difference between the titanium alloy of the present invention and the gum metal was more than 150 MPa.

In summary, the titanium alloy of the present invention corresponds closely to the target metal, that is, the beta titanium alloy which has properties of low elastic modulus less than 70 GPa, high strength, high corrosion resistance, non-cytotoxic behavior, superelasticity, and superplasticity. Therefore, the titanium alloy of the present invention may be applied in various fields including biomedical area, aerospace, and so on.

Figure 10:
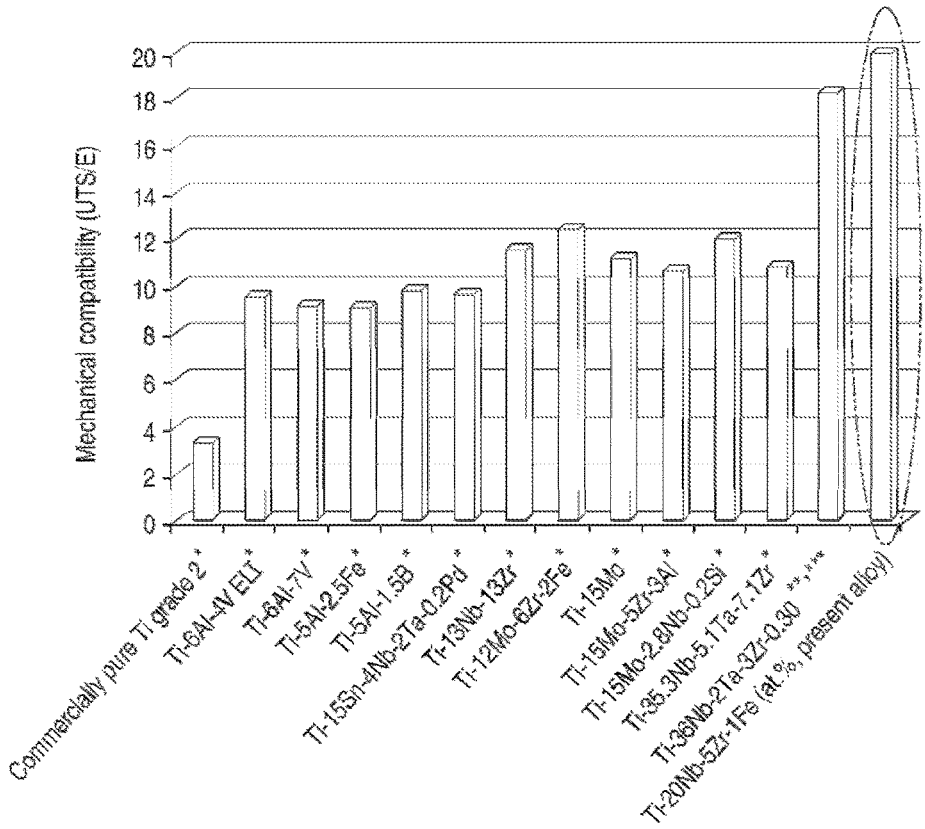
FIG. 10 is a graph showing mechanical compatibility (strength/elastic modulus) as an in vivo material for some of conventional titanium alloys and the titanium alloy of the present embodiment.

FIG. 10 is a graph showing mechanical compatibility (strength/elastic modulus) as an in vivo material for some of conventional titanium alloys and the titanium alloy of the present embodiment.

As shown in FIG. 10, the mechanical properties of the titanium alloy of the present invention are far more excellent than those of conventional alloys.

Figure 11A:
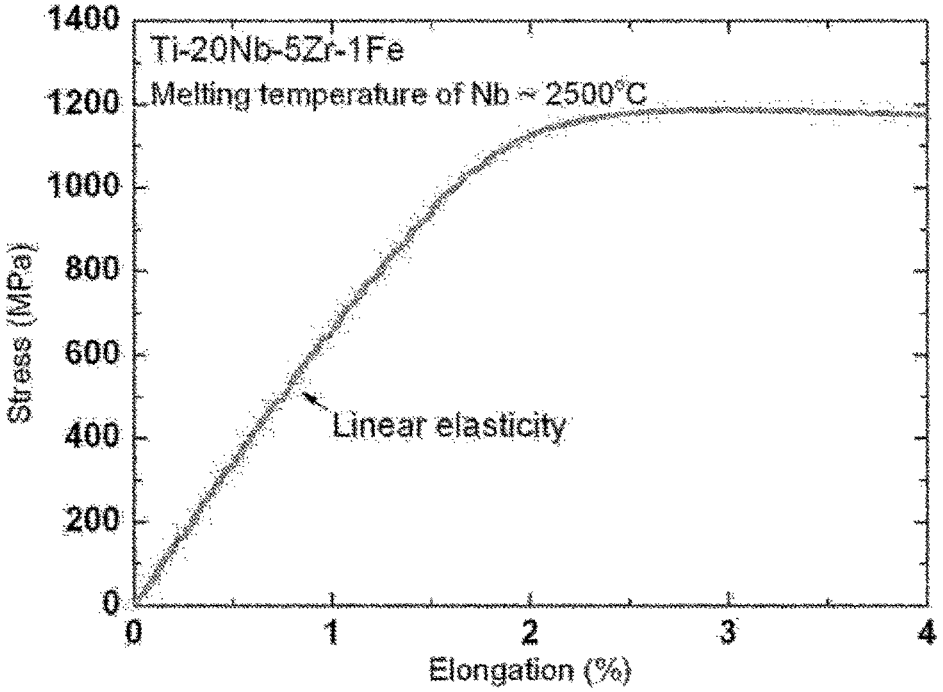
FIGS. 11*a* and 11*b* are graphs showing stress-elongation curves for the titanium alloy of the present embodiment and Ti-36Nb-2Ta-3Zr—O shown in FIG. 10.
Figures 11B, 12:
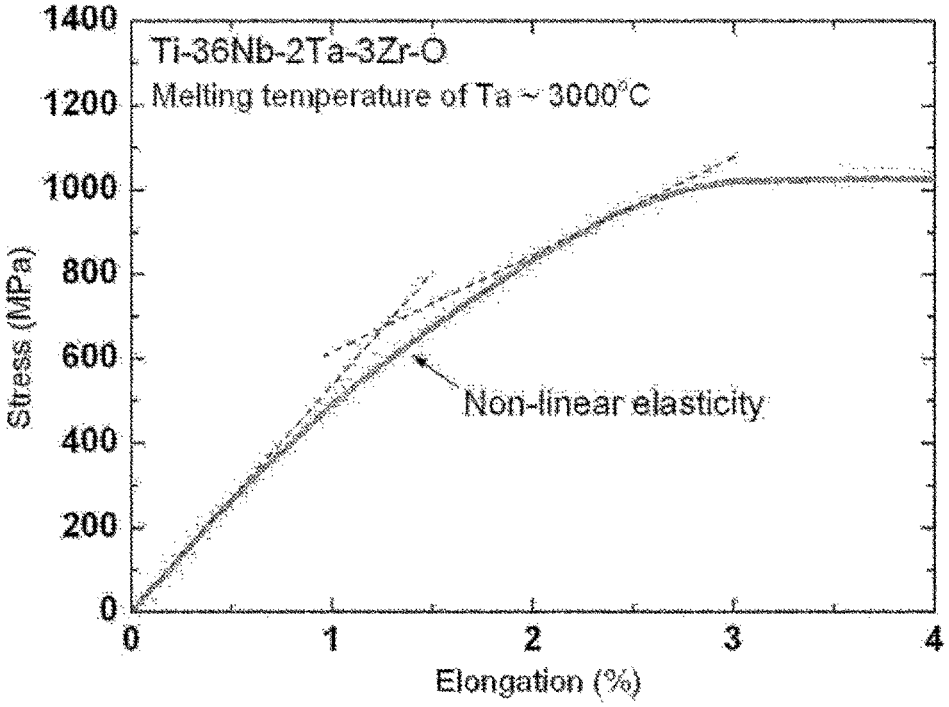
FIG. 12 is a table showing the values of tensile strength and elongation before and after cold deformation of the titanium alloy of the present embodiment.

FIGS. 11*a* and 11*b* are graphs showing stress-elongation curves for the titanium alloy of the present embodiment and Ti-36Nb-2Ta-3Zr—O shown in FIG. 10.

FIG. 11(*a*) shows the stress-elongation curve for the titanium alloy (Ti-20Nb-5Zr-1Fe—O) of the present invention, and FIG. 11(*b*) shows the stress-elongation for Ti-36Nb-2Ta-3Zr—O alloys which have the best mechanical properties among the materials already had developed. As shown in FIG. 11(*a*) and FIG. 11(*b*), the conventional Ti-36Nb-2Ta-3Zr—O alloys show non-linear elastic behavior, while the titanium alloy (Ti-20Nb-5Zr-1Fe—O) of the present invention shows linear elastic behavior and the amount of linear elastic deformation is more than 1%.

Further, the titanium alloy (Ti-20Nb-5Zr-1Fe—O) of the present invention does not contain Ta. The melting point of Ta is 3,000° C. which is much higher than the melting point of other metal components. Because Ta tends to inhomogeneously melt at about 2,500° C., which is approximately equal to the melting temperature of other metals, alloys containing Ta generally have the problem that their composition is highly inhomogeneous.

FIG. 12 is a table showing the tensile strength and elongation before and after cold deformation of the titanium alloy of the present embodiment.

The tensile strength of the titanium alloy of the present invention was more than 900 MPa before cold working and more than 1150 MPa after cold working, and the elongation the titanium alloy of the present invention was more than 18% before cold working and more than 8% after cold working. Such tensile strength and elongation are extremely improved, considering that the tensile strength and elongation for conventional alloys are normally 700 MPa and 2% respectively. Further, generally speaking, elongation becomes lower when strength become higher, while the titanium alloy (Ti-20Nb-5Zr-1Fe—O) of the present invention has improved elongation together with improved strength, which is a very astonishing fact.

In summary, compared with conventional titanium alloys, the titanium alloy (Ti-20Nb-5Zr-1Fe—O) of the present invention has excellent mechanical properties and can be cheaply produced. Further, because the titanium alloy of the present invention has ultrahigh strength and ultralow elastic modulus, and shows linear elastic deformation behavior, it may be employed in various fields including biomedical area, aerospace, and other industrial parts.

What is claimed is:

1. An ultrahigh strength and ultralow elastic modulus titanium alloy showing linear elastic deformation behavior and improved elongation characteristics, the titanium alloy consisting of titanium, niobium, zirconium, iron and oxygen, wherein the amount of niobium is 18 to 22 atomic percent (at. %), the amount of zirconium is 3 to 5 at. %, the amount of iron is 0.5 to 3.0 at. %, the amount of oxygen is 0.1 to 1.0 weight percent (wt. %), and the balance is titanium.

2. The titanium alloy of claim 1, wherein the elastic modulus of the titanium alloy is 68 gigapascal (GPa) before cold working and 60 GPa after cold working, and the titanium alloy shows linear elastic deformation behavior suitable for use as an in vivo material.

3. The titanium alloy of claim 1, wherein the amount of linear elastic deformation is more than 1%.

4. The titanium alloy of claim 1, wherein the tensile strength of the titanium alloy is more than 900 megapascal (MPa) before cold working and more than 1150 MPa after cold working, and the elongation of the titanium alloy is more than 18% before cold working and more than 8% after cold working.

5. An ultrahigh strength and ultralow elastic modulus titanium alloy showing linear elastic deformation behavior and improved elongation characteristics, the titanium alloy consisting of titanium, niobium, zirconium, iron and oxygen, wherein the amount of niobium is 18 to 22 atomic percent (at. %), the amount of zirconium is 3 to 7 at. %, the amount of iron is 0.5 to 3.0 at. %, the amount of oxygen is 0.1 to 1.0 weight percent (wt. %), and the balance is titanium.

6. The titanium alloy of claim 5, wherein the elastic modulus of the titanium alloy is 68 gigapascal (GPa) before cold working and 60 GPa after cold working, and the titanium alloy shows linear elastic deformation behavior suitable for use as an in vivo material.

7. The titanium alloy of claim 5, wherein the amount of linear elastic deformation is more than 1%.

8. The titanium alloy of claim 5, wherein the tensile strength of the titanium alloy is more than 900 megapascal (MPa) before cold working and more than 1150 MPa after cold working, and the elongation of the titanium alloy is more than 18% before cold working and more than 8% after cold working.

* * * * *